United States Patent [19]

Fountain

[11] 3,958,984

[45] May 25, 1976

[54] METHOD OF REMOVING A BRAZING ALLOY FROM STAINLESS STEEL

[76] Inventor: Laurence R. Fountain, 33 Brice Road, West Springfield, Mass. 01089

[22] Filed: Mar. 18, 1974

[21] Appl. No.: 452,454

[52] U.S. Cl. ..... 75/105; 75/118 R; 134/2; 134/3; 148/1; 156/18; 156/19; 204/146

[51] Int. Cl.[2] ..... C22B 3/00

[58] Field of Search ..... 423/105; 204/146, 145, 204/141.5, 32, 34; 156/18, 19; 252/79.1, 79.2, 79.4; 75/105, 117, 118; 148/1; 134/2, 3, 26, 28, 29, 41

[56] References Cited

UNITED STATES PATENTS

| | | | |
|---|---|---|---|
| 1,994,499 | 3/1935 | Boller | 156/18 |
| 2,649,361 | 8/1953 | Springer et al. | 156/18 |
| 2,937,940 | 5/1960 | Weisberg et al. | 204/146 |
| 3,367,874 | 2/1968 | Haviland et al. | 252/79.2 |
| 3,543,389 | 12/1970 | Baldauf et al. | 252/79.1 |
| 3,819,494 | 6/1974 | Fountain | 204/146 |

OTHER PUBLICATIONS

Tweney, C. (Ed.); *Chamber's Technical Dictionary*, New York, 1944, p. 579, (Nitric Acid).

Lyman, et al.; *ASM Metals Handbook*, Vol. 2, (Heat-Treating, Cleaning & Finishing) p. 605, (1964).

Hawley, G.; *Condensed Chemical Dictionary*, New York, 1971, (Aqua. Regis.) p. 74.

*Primary Examiner*—Walter R. Satterfield

*Attorney, Agent, or Firm*—Chapin, Neal and Dempsey

[57] ABSTRACT

A method of removing high temperature brazing alloys from a stainless steel base wherein the brazing alloy is treated with an aqueous solution of an alkali cyanide and a nitro-substituted aromatic compound and also with an acid solution containing a minor amount of a base metal attack inhibitor.

5 Claims, 2 Drawing Figures

METHOD OF REMOVING A BRAZING ALLOY FROM STAINLESS STEEL

BACKGROUND OF THE INVENTION

The present invention relates to a process for removing high temperature brazing alloys from a stainless steel surface. In particular, it relates to the removal of brazes wherein the principal ingredient of the alloy forming the braze is gold, silver, nickel or copper.

Heretofore, many processes have been devised for the removal of metals from the surface of an object on which they have been deposited by coating, plating or otherwise. However, most all of said processes deal only with the removal of a pure metal coating and not an alloy, such as is the makeup of a braze. Details of two such processes may be had by reference to U.S. Pat. Nos. 2,649,361 and 3,663,388. Of the processes that do deal with alloy removal, none appear to provide reasonable rates of removal.

In my copending application entitled "Method of Removing Braze", Ser. No. 346,181, filed Mar. 29, 1973 now U.S. Pat. No. 3,819,494, there is disclosed a novel method of removing braze containing minor amounts of an exotic metal such as palladium or nioboim. The basic research behind the method of said application, has led to a new method for economically and expeditiously removing standard high temperature brazes from stainless steel.

SUMMARY OF THE INVENTION

Accordingly, it is an object of this invention to provide a method of removing high temperature brazing alloys from stainless steel base materials.

It is another object of this invention to provide a fast and inexpensive method of removing high temperature brazing alloys from stainless steel.

The above and other objects and advantages of the present invention will become clear in view of the following specification and drawings in which.

While some prior methods for the removal of brazing alloys have proved successful, most all of said methods require a great amount of time and expense. With this in mind, a method has been developed for the removal of high temperature brazing alloys from stainless steel bases. The method basically involves the following steps:

1. Cleaning the base metal and braze of foreign material, such as dust and grease and the like;
2. Rinsing;
3. Treating the braze with an aqueous solution containing a water-soluble alkali cyanide, and a nitro-substituted aromatic compound.
4. Rinsing;
5. Treating the braze with an acid solution; and
6. Rinsing.

The above steps, with the exception of Step 1, are repeated if the braze is not totally removed in one sequence.

In further explanation of the process, the steps thereof are explained in more detail below:

STEP 1 — CLEANING

This step of the process involves the cleaning of the surface of the braze that is to be stripped as well as the adjacent base metal. Basically, the removal of organic dirt and the like is accomplished by the action of known degreasers, various acid treatments and/or anodic cleaning.

STEP 2 — RINSING

A water rinse.

STEP 3 — INITIAL STRIP

In this strip, the primary metal of the braze is attacked by dissolving the same in an aqueous solution of a water-soluble alkali cyanide and a nitro-substituted aromatic compound, optionally in the presence of a compatible wetting agent. The stripping bath is employed at a temperature range of from room temperature to about 185°F, with a temperature of about 160° to 180°F being preferred with the residence time of the braze in the bath being from about 20 to 30 minutes.

As disclosed in U.S. Pat. 2,649,361 and my copending application referenced above, typical alkali cyanides include the ammonium cyanides and those alkali metal and alkali earth cyanides which are ionizable in water to give cyanide ions and which are soluble in water The nitro-substituted aromatic compounds referred to are typically nitrobenzoic acid and derivatives thereof such as sodium m-nitrobenzoate, nitroaniline, nitrophenol, etc.

STEP 4 —RINSING

A water rinse.

STEP 5 — ACID STRIP

This acid strip is employed to attack oxides formed during the initial strip and also the various other metals of the braze. In general, this acid strip solution employs up to 50% of nitric acid, a minor amount of hydrochloric acid and a base metal attack inhibitor. The temperature of this stripping bath should be about 100° to 120°F, with the residence time of the braze in the bath being about 30 seconds to about 5 minutes.

STEP 6 — RINSING

A water rinse.

The method of the present invention is further illustrated by the following Example:

EXAMPLE I

Figure 1:
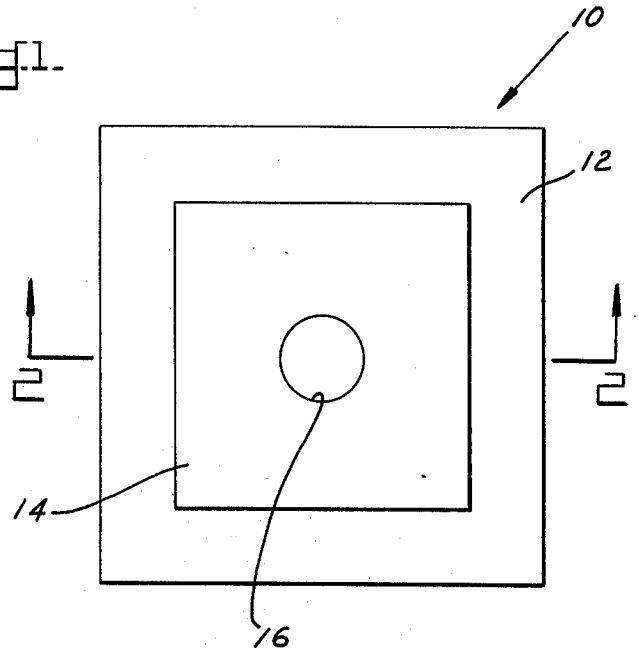
FIG. 1 is a top plan view of a sample tester.
Figure 2:
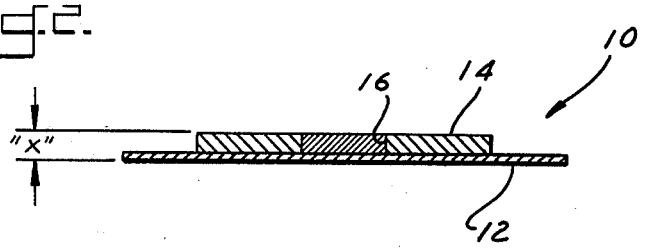
FIG. 2 is a view taken along the line 2—2 of FIG. 2.

A sample tester indicated at 10 in FIGS. 1 and 2 and comprising a bottom plate 12 and a top plate 14 affixed thereto having a sample cavity 16 therein was formed from Type 400 stainless steel. An 85% gold/15% nickel brazing alloy was brazed into the sample cavity 16 and machined so as to completely fill the cavity. The braze was then treated as follows:

1. The sample tester and the braze were degreased and otherwise cleaned as is well known in the art.
2. Following a water rinse, the tester and braze were placed in an aqueous bath heated to a temperature of about 170° to 180°F and containing about 4 oz/gal of sodium m-nitrobenzoate, 4 oz/gal of sodium cyanide and 0.2% by volume of ethylene diamine tetraacetic acid (a wetting agent). The sample was held in this bath for a period of about 25 minutes and then removed.
3. Following another water rinse, the tester and braze were placed in an acid bath heated to about 110°F and containing 40% by volume of nitric acid (42°

Be), 1.5% by volume hydrochloric acid (20° Be) and 0.15% by weight/volume of copper sulfate (an inhibitor). After a residence time of approximately 5 minutes, the part was removed, water rinsed, dried and a thickness measurement of the braze ($x$ as shown in FIG. 1) was taken.

The above cycle was repeated and thickness measurements taken at about 30 minute intervals. The results are tabulated below:

| Time (min.) | Thickness X (inches) | Amount Stripped in 30 min. (inches) | Cumulative Amount Stripped (inches) |
|---|---|---|---|
| 0 | 0.8518 | 0.0000 | 0.0000 |
| 30 | 0.8501 | 0.0017 | 0.0017 |
| 60 | 0.8478 | 0.0023 | 0.0040 |
| 90 | 0.8467 | 0.0011 | 0.0051 |
| 120 | 0.8443 | 0.0024 | 0.0075 |
| 150 | 0.8428 | 0.0015 | 0.0090 |
| 180 | 0.8415 | 0.0013 | 0.0103 |
| 210 | 0.8395 | 0.0020 | 0.0123 |
| 240 | 0.8380 | 0.0015 | 0.0138 |
| 270 | 0.8368 | 0.0012 | 0.0150 |
| 300 | 0.8355 | 0.0013 | 0.0163 |
| 330 | 0.8335 | 0.0020 | 0.0183 |
| 360 | 0.8320 | 0.0015 | 0.0198 |
| 390 | 0.8305 | 0.0015 | 0.0213 |
| 420 | 0.8290 | 0.0015 | 0.0228 |
| 450 | 0.8268 | 0.0022 | 0.0250 |
| 480 | 0.8245 | 0.0023 | 0.0273 |
| 510 | 0.8229 | 0.0016 | 0.0289 |
| 540 | 0.8205 | 0.0024 | 0.0313 |
| 570 | 0.8193 | 0.0012 | 0.0325 |
| 600 | 0.8175 | 0.0018 | 0.0343 |
| 630 | 0.8155 | 0.0020 | 0.0363 |
| 660 | 0.8135 | 0.0020 | 0.0383 |
| 690 | 0.8115 | 0.0020 | 0.0403 |
| 720 | 0.8100 | 0.0015 | 0.0418 |

In the above experiment, the various baths were maintained with appropriate additions made at the 180 minute and 540 minute marks.

As can readily be calculated, the average stripping rate based on 12 hours was approximately 0.0035 inches of braze/hour.

Similar experiments were conducted on the following brazing alloy compositions and gave similar results: silver/copper, silver/copper/nickel, silver/copper/zinc-/cadmium; nickel/silicon/boron and the like.

That which is claimed is:

1. A method of removing a high temperature brazing alloy from stainless steel wherein said brazing alloy contains a major amount of a metal selected from the group consisting of gold, silver and nickel, said method comprising treating said brazing alloy with an aqueous solution of an alkali cyanide and a nitro-substituted aromatic compound at a temperature of about 160° to 180°F, rinsing said brazing alloy in water and treating said brazing alloy in an acid solution containing 40% to 50% by volume nitric acid at a temperature of about 100° to 120°F.

2. The method of claim 1 wherein said alkali cyanide is sodium cyanide and said nitro-substituted aromatic compound is sodium m-nitrobenzoate.

3. The method of claim 2 wherein said acid solution contains minor amounts of hydrochloric acid and copper sulfate.

4. The method of claim 1 wherein said aqueous solution also contains a minor amount of a wetting agent.

5. The method of claim 4 wherein said wetting agent is ethylene diamine tetraacetic acid.

* * * * *

UNITED STATES PATENT OFFICE

CERTIFICATE OF CORRECTION

Patent No. 3,958,984 Dated May 25, 1976

Inventor(s) Laurence R. Fountain

It is certified that error appears in the above-identified patent and that said Letters Patent are hereby corrected as shown below:

The term of this patent subsequent to June 25, 1991, has been disclaimed.

Signed and Sealed this

Sixth Day of July 1976

[SEAL]

*Attest:*

RUTH C. MASON
*Attesting Officer*

C. MARSHALL DANN
*Commissioner of Patents and Trademarks*